United States Patent [19]

Endl et al.

[11] Patent Number: 5,019,205

[45] Date of Patent: May 28, 1991

[54] APPARATUS FOR WET ETCHING OF THIN FILMS

[75] Inventors: Helmut Endl, Freising; Helmut Rinck, Langenbach, both of Fed. Rep. of Germany

[73] Assignee: Texas Instruments Deutschland GmbH, Fed. Rep. of Germany

[21] Appl. No.: 364,266

[22] Filed: Jun. 9, 1989

[30] Foreign Application Priority Data

Jun. 16, 1988 [DE] Fed. Rep. of Germany ..... 3820591

[51] Int. Cl.[5] ..... C23F 3/00

[52] U.S. Cl. ..... 156/345; 156/640; 156/642; 134/153; 134/159; 118/320

[58] Field of Search ..... 156/640, 642, 345; 118/320; 134/153, 157, 159, 148

[56] References Cited

U.S. PATENT DOCUMENTS

| | | | |
|---|---|---|---|
| 2,741,594 | 4/1956 | Bowersett | 156/640 |
| 3,898,095 | 8/1975 | Berdan et al. | 156/651 |
| 3,964,957 | 6/1976 | Walsh | 156/345 |
| 4,482,425 | 11/1984 | Battey | 156/345 |

FOREIGN PATENT DOCUMENTS

| | | | |
|---|---|---|---|
| 1281229 | 10/1968 | Fed. Rep. of Germany . | |
| 1544282 | 2/1969 | Fed. Rep. of Germany . | |
| 0068633 | 5/1980 | Japan | 156/642 |
| 0115332 | 9/1980 | Japan | 134/153 |
| 537464 | 7/1973 | Switzerland . | |
| 597363 | 3/1978 | Switzerland . | |

OTHER PUBLICATIONS

M. Gagne, Spray Unit, IBM Technical Disclosure Bulletin pp. 1362–1363, vol. 23, No. 4, Sep. 1980.

*Primary Examiner*—Kenneth M. Schor
*Assistant Examiner*—Todd J. Burns
*Attorney, Agent, or Firm*—William E. Hiller; N. Rhys Merrett; Melvin Sharp

[57] ABSTRACT

An apparatus for wet etching of thin films with which etching rate differences as between various regions of a respective thin film down to only 5% can be achieved. The apparatus includes a housing (10) providing a liquid treatment chamber in which at least one rotational-symmetrical basket (12; 14) is arranged for accommodating semiconductor slices (16) having the thin films to be etched. The basket (12, 14) rests on two rollers (18, 20; 22), one of which is driven. Longitudinally above the basket (12; 14), flat jet nozzles (24) are arranged in such a manner that the jets of etching solution sprayed out of the nozzles form a homogeneous flat jet (26). The flat jet (26) is directed laterally in the direction of the axis of symmetry of the basket (12; 14). With this apparatus, overflow conditions on the surfaces of the slices (16) to be processed are obtained which are so uniform that the apparatus is suitable for use in the wet etching of aluminium layers in device fabrication.

4 Claims, 1 Drawing Sheet

APPARATUS FOR WET ETCHING OF THIN FILMS

The invention relates to an apparatus for etching of thin films which is used in particular in semiconductor fabrication.

Such apparatuses serve for example for processing aluminium layers which are applied to a semiconductor slice and covered with a mask. The exposed areas, i.e. those not covered with the mask, are etched away by the wet etching operation.

However, in etching aluminium layers in semiconductor fabrication, in which extremely fine structures must be made with high precision, a number of problems have to be solved. Firstly, in the etching of the aluminium, gaseous reaction products form which can adhere in uncontrolled manner to the surface and thus lead to undefined mask formation. Such covered aluminium layers are not etched away so that frequently undesirable aluminium residues remain in corners and between narrow structures.

A further problem resides in that the etching operation is partially diffusion-controlled. The mass transfer rate is decisively influenced here by the diffusion processes in the concentration boundary layer of which the thickness depends on the thickness of the flow boundary layer. When the etching solution flows over the solid surface, etching rate differences result. However, overetching is precisely what is to be avoided because when etching the fine aluminium geometries, the width of the mask is often only six times the layer thickness.

In the prior art for wet etching thin films, apparatuses have been known for a long time which operate by the immersion etching method. In this method, the slices to be etched are moved up and down in the etching solution. Even with optimum adjustment, etching rate differences of 30% arise. This means that the region with the maximum etching rate on the slice surface is overetched about 30% compared with that of the smallest etching rate.

Smaller etching rate differences are achieved with apparatuses in which the slices to be etched are spread out on an inclined plane and an etching solution with high volume flow is caused to flow thereover. Admittedly, in this case etching rate differences of 10% are achieved, but due to the high etching solution volume flow, the charging and discharging expenditure involved is disproportionately high.

Etching rate differences of 10% are also achieved with the so-called "single-slice spin etchers". In this case one of the slices to be processed rotates on a vacuum plate and is sprayed with acid perpendicularly to the surface. However, with such apparatuses, only one slice can be etched in a processing operation so that the throughput for each apparatus is very limited.

The problem therefore arises of making available an apparatus for wet etching of thin films which has the smallest possible etching rate differences while minimizing the operating expenditure involved and achieving the highest possible throughput.

In accordance with the present invention, an apparatus is provided for subjecting semiconductor slices to a liquid treatment, such as the wet etching of thin films provided thereon, wherein the apparatus comprises a housing in which a liquid treatment chamber is provided with at least one substantially cylindrical basket providing a slice carrier of open framework arranged in the chamber. A plurality of semiconductor slices are mounted within the carrier in fixed relationship, with the slices being arranged in spaced substantially parallel concentric relationship such that the respective axes of the slices coincide with the longitudinal axis of the carrier. A jet spray assembly is mounted within the chamber above the carrier and is provided with a flat jet spray nozzle for directing a substantially flat jet spray of liquid transversely across the longitudinal axis of the carrier and along the extent thereof. A rotatable driving mechanism imparts rotation to the carrier about the longitudinal axis thereof. As the carrier is rotated about its longitudinal axis, the fixedly mounted semiconductor slices in the carrier are rotated therewith while a flat jet spray of liquid is being directed by the jet spray nozzle across and along the extent of the longitudinal axis of the carrier to wet the opposite faces of each of the semiconductor slices with the liquid in performing wet etching of thin films on the respective slices. With an apparatus according to this invention, firstly the resulting gas bubbles formed as reaction products from the wet etching treatment are removed as rapidly as possible from the surface of the thin film being etched and secondly a uniform flow over the slice surface is achieved. A particular advantage is that when using the apparatus according to the invention, in one etching operation a great number of slices are simultaneously processed, giving a high throughput of slices of uniform surface quality.

In a specific aspect of the apparatus, the drive mechanism imparting rotation to the basket in which the semiconductor slices are mounted comprises a drive roller and an idler roller located beneath the basket and on which the basket rests, such that the drive roller upon being rotated imparts rotation to the basket. The construction contained therein of the drive mechanism for the rotation-symmetrical basket permits in particular simple replacement of the basket.

Further, the apparatus may be provided with a container disposed beneath the housing in which the liquid treatment chamber is provided, with the housing having a drain outlet connected to the container for providing communication between the liquid treatment chamber of the housing and the container disposed therebeneath. The container maintains the temperature of the liquid collected therein from the liquid treatment chamber of the housing at a temperature level appropriate to the etching process and is connected to the jet spray nozzle within the liquid treatment chamber of the housing via a conduit system in which a pump and an adjustment valve are interposed. Thus, the etching solution running off the etched slices can be collected, adjusted to the temperature level necessary for the process and returned in the cycle to act upon the slices again.

For process monitoring, the housing may include a transparent hood permit observation of the operation at any time.

Although the use of the apparatus according to the invention in aluminium etching is particularly advantageous, the apparatus can also be used equally well for the wet etching of other layers with and without an overlying masking.

Further details, features and advantages of the invention will be apparent from the following description of the embodiment illustrated in the drawings, wherein.

Figure 1:
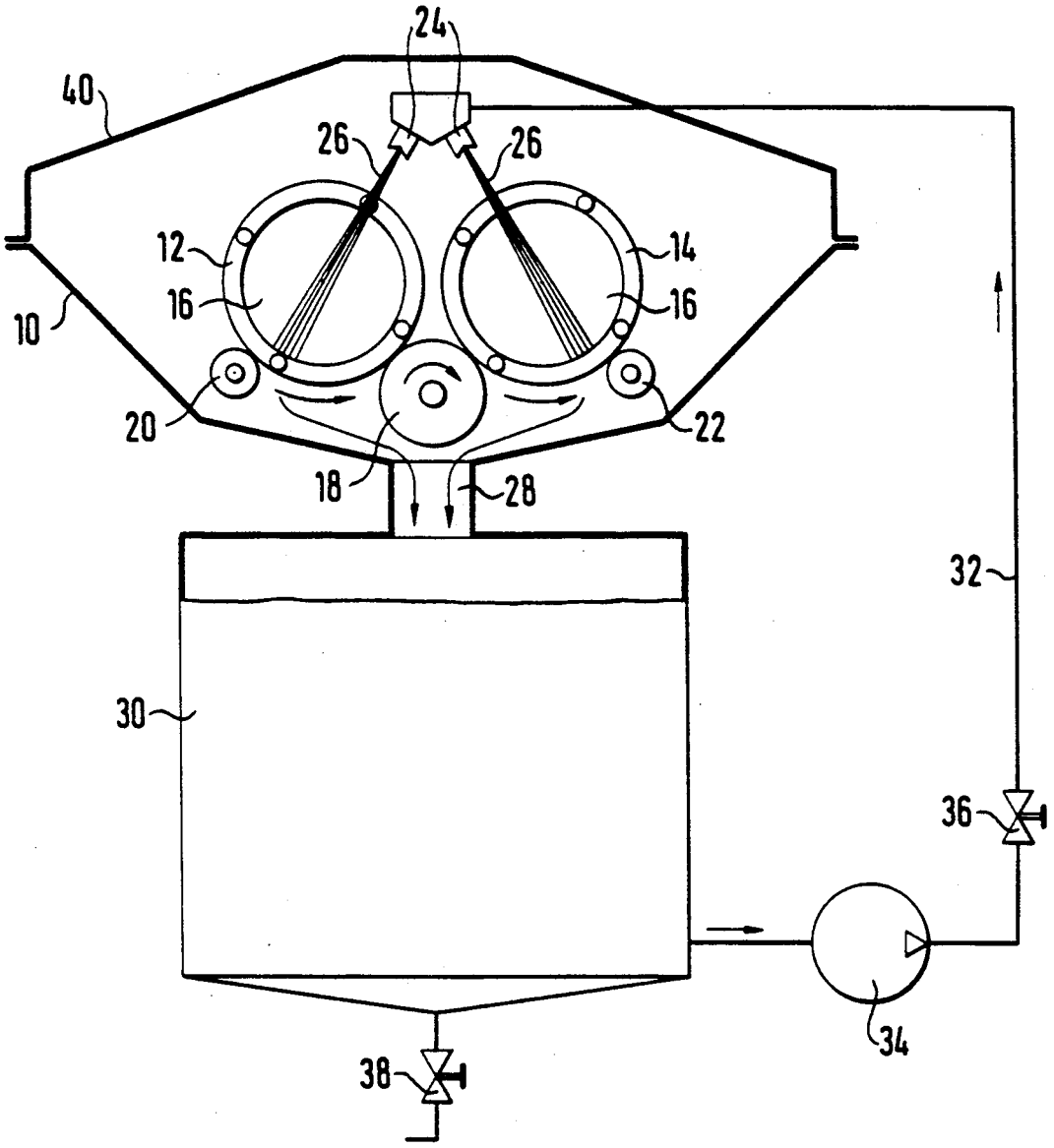
FIG. 1 is a schematic illustration of the entire wet etching apparatus.

In FIG. 1 the wet etching apparatus is illustrated in a double-basket construction. In a closed housing 10, two baskets 12 and 14 are disposed. The baskets 12 and 14 are made cylindrical. They serve to receive the slices 16 to be etched. The baskets 12 and 14 are each mounted rotatably on one of the two outer support rollers 20 and 22 respectively and a drive roller 18 disposed centrally therebetween.

Arranged centrally above the baskets 12 and 14 are flat jet nozzles 24 extending longitudinally of said baskets. The flat jet nozzles 24 extend in two rows. One is directed onto the basket 12 and the other onto the basket 14. The flat jet nozzles 24 of one row are arranged in such a manner that the etching solution sprayed out from them gives a homogeneous flat jet 26. The two flat jets 26 are directed laterally in the direction of the axis of symmetry of the respective sprayed basket 12 or 14.

The housing 10 is made boat-shaped so that the etching solution flowing from the baskets 12 and 14 runs together centrally to a drain 28. Beneath this drain there is a temperature regulation container 30 in which the etching solution running off is collected and adjusted to the temperature level necessary for the etching operation. From the temperature regulation container 30, a conduit system 32 including a pump 34 and an adjusting valve 36 leads back to the flat jet nozzles 24 so that the etching solution can be recycled for further use in the etching process. At the temperature regulation container, a drain valve 38 is also provided from which used etching solution can be withdrawn.

Figure 2:
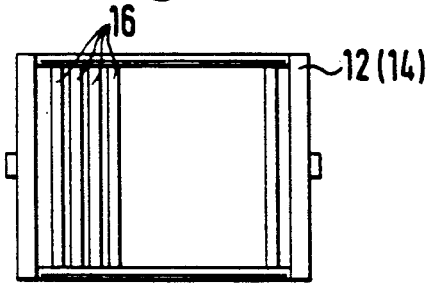
FIG. 2 is a basket of the wet etching apparatus of FIG. 1 shown schematically in longitudinal section.

FIG. 2 shows how the slices 16 to be etched can be aligned parallel to each other in the cylindrical baskets 12 and 14. The circular slices 16 are inserted concentrically into the baskets 12 and 14.

In operation, as the baskets 12 and 14 are being rotated by the rotation of the drive roller 18, the slices 16 in the baskets 12 and 14 are subjected to the etching solution emerging in flat jets 26. The uniformity of the etching rate can be set firstly by the rotational speed of the drive roller 18 and secondly via adjustment of the volume flow of the etching solution by means of the adjusting valve 36. Etching rate differences of only 5% can be achieved with this apparatus.

A visual supervision of the etching operation is made possible by the upper portion of the housing 10 being formed as transparent hood 40.

We claim:

1. Apparatus for subjecting semiconductor slices to a liquid treatment, said apparatus comprising:

a housing providing a liquid treatment chamber therewithin; at least one substantially cylindrical basket providing a slice carrier, said basket being of open framework and disposed in the chamber of said housing, said carrier being adapted to receive a plurality of semiconductor slices in fixed, spaced substantially parallel concentric relationship with the respective axes of the plurality of semiconductor slices coinciding with the longitudinal axis of said carrier;

jet spray means mounted within the chamber of said housing in spaced relation to said carrier for directing a substantially flat jet spray of liquid transversely across the longitudinal axis of said carrier and along the extent thereof;

means operably connected to said carrier for imparting rotation thereto about the longitudinal axis of said carrier, said rotation-imparting means comprising:

a pair of rollers mounted within the chamber of said housing and having respective longitudinal axes in spaced parallel relation with respect to the longitudinal axis of said carrier, one of said rollers being a drive roller and the other roller being an idler roller, and said basket being disposed on said pair of rollers and in engagement therewith and being rotated in one of a clockwise direction and a counterclockwise direction in response to the rotation of said drive roller in the other of a clockwise direction and a counterclockwise direction; and means for providing liquid to said jet spray means;

whereby said carrier is rotated about its longitudinal axis in response to the rotation of said drive roller upon actuation of said rotation-imparting means such that the fixedly mounted semiconductor slices therein are rotated with the carrier while a flat jet spray of liquid is being directed by said jet spray means across and along the extent of the longitudinal axis of said carrier to wet the opposite faces of each of the semiconductor slices with the liquid.

2. Apparatus as set forth in claim 1, further including a container disposed beneath said housing;

said housing having a drain outlet at the bottom thereof connected to said container and providing communication between the chamber within said housing and the interior of said container for discharging liquid used in the liquid treatment of the plurality of semiconductor slices from the chamber into said container;

conduit means connecting said container with said jet spray means within the chamber of said housing;

a pump interposed in said conduit means for transmitting liquid from said container via said conduit means to said jet spray means as a source of liquid therefor; and an adjusting valve disposed in said conduit means between the output of said pump and said jet spray means for regulating the quantity of liquid transmitted to said jet spray means via said conduit means.

3. Apparatus as set forth in claim 1, wherein said housing is segmental and includes a lower housing portion and a cover received by the lower housing portion and defining an enclosure with said lower housing portion comprising the liquid treatment chamber;

said cover of said housing serving as a hood and being made of transparent material, thereby providing visibility of said liquid treatment chamber within said housing.

4. Apparatus for subjecting semiconductor slices to a liquid treatment, said apparatus comprising:

a housing providing a liquid treatment chamber therewithin;

first and second substantially cylindrical baskets providing respective first and second carriers, said baskets being of open framework and disposed in the chamber of said housing, the longitudinal axes of said first and second carriers being in spaced parallel relation with respect to each other, each of said first and second carriers being adapted to receive a plurality of semiconductor slices in fixed, spaced, substantially parallel concentric relationship with the respective axes of the plurality of semiconductor slices coinciding with the longitudinal axis of the carrier in which the semiconductor slices are received;

jet spray means mounted within the chamber of said housing in spaced relation to said first and second carriers for directing a substantially flat jet spray of liquid transversely across the longitudinal axis of each carrier and along the extent of each carrier, said jet spray means including first and second rows of flat jet nozzles mounted within the chamber of said housing above and in spaced relation to said first and second carriers, said first row of flat jet nozzles and said second row of flat jet nozzles being respectively disposed in relation to the longitudinal axis of the first or second carrier corresponding respectively thereto for directing a substantially flat jet spray of liquid transversely across the longitudinal axis of said carrier corresponding thereto and along the extent thereof;

means operably connected to said first and second carriers for imparting rotation thereto about the longitudinal axes of said first and second carriers, said rotation-imparting means comprising:

a set of rollers mounted within the chamber of said housing and disposed beneath said first and second carriers, said set of rollers including an intermediate drive roller and a pair of idler rollers disposed in spaced relation to said drive roller and on opposite sides of said drive roller, said drive roller and one of said idler rollers supporting said first basket and said drive roller and the other of said idler rollers supporting said second basket, the rotation of said drive roller in one of a clockwise direction and a counterclockwise direction imparting rotation to each of said first and second carriers in the other of a clockwise direction and a counterclockwise direction such that the fixedly mounted semiconductor slices within said first and second carriers are rotated with said first and second carriers;

means for providing liquid to said first and second rows of flat jet nozzles of said jet spray means;

said first and second carriers being rotated about their respective longitudinal axes in response to the rotation of said drive roller upon actuation of said rotation-imparting means such that the fixedly mounted semiconductor slices within said first and second carriers are rotated with said first and second carriers as respective flat jet sprays of liquid are directed by said first and second rows of flat jet nozzles of said jet spray means across and along the extent of the longitudinal axes of said first and second carriers to wet the opposite faces of each of the semiconductor slices, as mounted within said first and second carriers, with the liquid.

* * * * *